US005820443A

United States Patent [19]

Burr

[11] Patent Number: 5,820,443

[45] Date of Patent: Oct. 13, 1998

[54] LADIES' UNDERGARMENT, IN PARTICULAR A BRASSIERE

[75] Inventor: Reinhold Markus Burr, Böbingen, Germany

[73] Assignee: Triumph International Aktiengesellschaft, Munich, Germany

[21] Appl. No.: 865,000

[22] Filed: May 29, 1997

[30] Foreign Application Priority Data

May 31, 1996 [DE] Germany ..... 296 09 672.5

[51] Int. Cl.[6] ..... A41C 3/12; A41C 5/00

[52] U.S. Cl. ..... 450/40; 450/39; 450/93

[58] Field of Search ..... 2/73, 2.5, 1, 463, 2/243.1; 450/39, 40, 1, 93, 19, 20, 21, 74, 75, 76

[56] References Cited

U.S. PATENT DOCUMENTS

| | | | |
|---|---|---|---|
| 2,659,085 | 11/1953 | Ericson | 450/39 |
| 2,721,323 | 10/1955 | Spanel et al. | 450/39 |
| 2,772,418 | 12/1956 | Spanel | 450/39 |
| 2,797,415 | 7/1957 | Spanel et al. | 450/39 |
| 2,824,563 | 2/1958 | Hill | 450/39 |
| 5,154,659 | 10/1992 | Gluckin . | |

FOREIGN PATENT DOCUMENTS 0255101 11/1993 European Pat. Off. .

*Primary Examiner*—Jeanette E. Chapman
*Attorney, Agent, or Firm*—Friedrich Kueffner

[57] ABSTRACT

A ladies' undergarment with a molded upper part, in particular a brassiere has two side parts which include cups, are joined together in the front central area between the cups, have a back fastener at the back ends and are provided with shoudler straps. Each side part includes a blank which covers their entire surfaces and is of a textile material which is composed at least in part of thermoplastically fusible fibres. Reinforcement parts are bonded to the blank parts at least along their outer edges. The reinforcement parts are also of a textile material which is composed at least in part of thermoplastically fusible fibres. The side parts are joined together in the front central area by a thermally produced weld. The parts of the back fastener as well as the shoulder straps are indirectly or directly joined to the side parts by thermally produced welds.

13 Claims, 3 Drawing Sheets

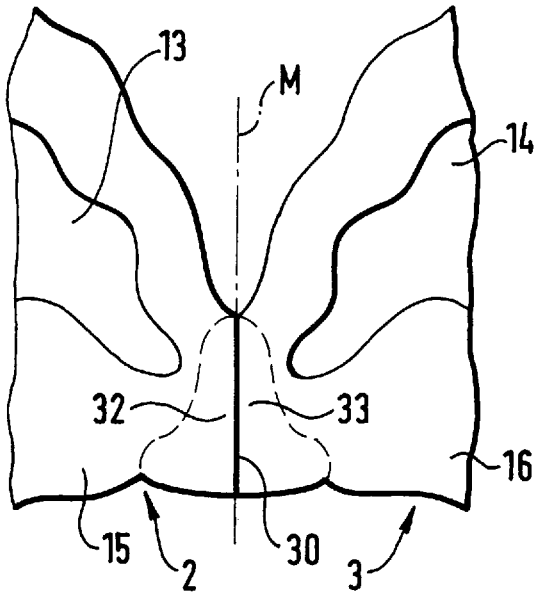
FIG. 4A
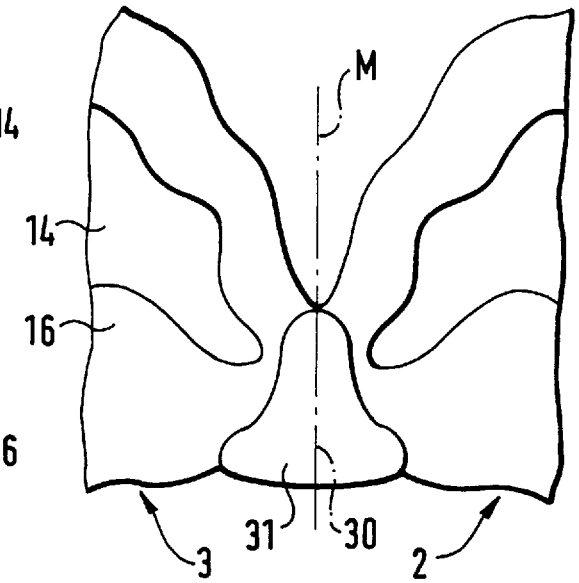
FIG. 4B
FIG. 5
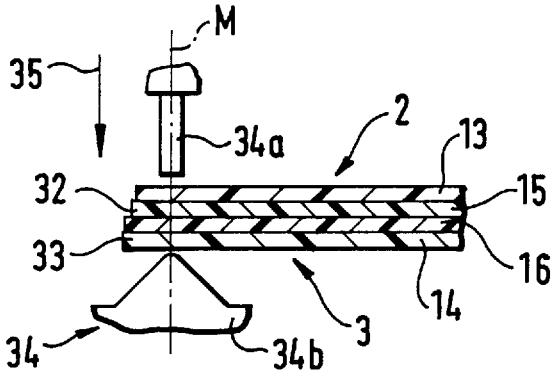
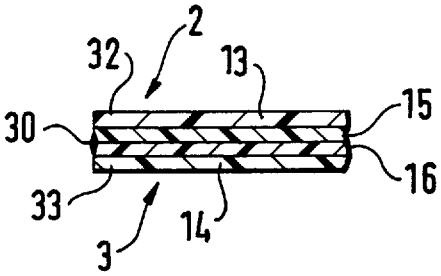
FIG. 6
FIG. 7
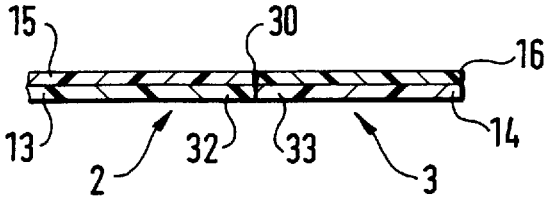

LADIES' UNDERGARMENT, IN PARTICULAR A BRASSIERE

BACKGROUND OF THE INVENTION

1. Field of the Invention

The present invention relates to a ladies' undergarment with a molded upper part, in particular a brassiere. The undergarment has two side parts which include cups, are joined together in the front central area between the cups, have a back fastener at the back ends and are provided with shoudler straps.

2. Description of the Related Art

Brassieres are undergarments which, in view of the fact that their purpose is to cover, support and shape breasts, must be manufactures and stocked in many different sizes and shapes. Because of their three-dimensional shape, which is adapted to this purpose, they usually consist of a plurality of different parts, the assembly of which requires a plurality of operating steps which involves a lot of time and labor costs and, thus, cannot be produced economically. Apart from the fact that a brassiere consists of a number of different parts, usually of textile material, such as side parts, cups, shoulder straps, trimming or edging, back fastener, etc., these parts have to be joined together by sewing according to conventional methods. This necessitates not only a sewing operation along the junction points, but also the use of a joining medium, e.g., sewing thread.

On the one hand, there has been no lack of attempts in the prior art to simplify this complex manufacturing process, and on the other hand, it was also attempted to find a fit which embraces as many different sizes and shapes as possible, and, finally, to combine these two conditions.

A brassiere sold under the name "One for all" known in the art is composed of two side parts which are each made as a single part, comprise the cups and consist of a textile, stretchable material. These parts are each reinforced at the edges by strips of an elastic material which are joined to the side parts by spot welding. This method has also been used to produce shoulder straps, where at least the reinforcement strips extend along the shoulder straps from the side parts. Although this type of edge reinforcement has made joining by sewing unnecessary, it still takes time to move around the edges of the brassiere to produce the weld joints. Furthermore, it has not been possible to dispense with seams for joining the side parts or attaching the fastener parts or straps.

It has also become known—particularly in order to increase the wear comfort of brassieres into which reinforcement parts such as, for example, wales, bones or similar parts are worked to increase the shaping power—to bond blank parts in the shape of the areas to be reinforced and consisting of an approximately stronger material to a weldable polyester material, and then to bring these parts into contact with a second continuous workpiece of a stretchable material and join them by heating to form a three-layer workpiece, as disclosed in U.S. Pat. No. 5,154,659. Following cooling, the cups are molded out of the elastic base material in the area of the breasts. The side parts of this brassiere are also joined together along the front central axis by thread in a sewing operation and its back fastener parts and shoulder straps are also sewn on.

In order to reinforce selected areas of a garment such as, e.g., a panty girdle or a brassiere, it is also known in the art, to apply an adhesive in powder form to a textile material base in certain patterns using a screen printing process and then to fuse the adhesive in a treating oven (EP 0 255 101 B1). A top layer corresponding to the areas of the adhesive application is then applied to the areas of the base which are thus coated with adhesive and joined to the base by means of the adhesive as a result of applying heat and pressure. The strength and the shaping properties are in this case determined by the form and the extent of the adhesive application as well as by the choice of adhesive material. This brassiere is also subsequently made up by sewing.

SUMMARY OF THE INVENTION

Therefore, it is the primary object of the present invention to provide a ladies' undergarment, in particular a brassiere, which is suitable for modern industrial manufacture and which in particular avoids any continuous sewing operations requiring a joining medium.

In accordance with the present invention, in a ladies' undergarment, in particular a brassiere, of the above-described type, each side part includes a blank which covers their entire surfaces and is composed of a textile material which comprises at least in part thermoplastically fusible fibres. Reinforcement parts are bonded to the blank parts, as least along their outer edges. The reinforcement parts are also composed of a textile material which comprises at least in part thermoplastically fusible fibres. The side parts are joined together in the front central area by a weld produced by thermal means. The parts of the back fastener as well as the shoulder straps are indirectly or directly joined to the side parts by welds produced by thermal means.

As opposed to conventional joining techniques, in particular by sewing, not only can the brassiere according to the invention be produced without any threads or similar joining means, but also practically only operating steps which can be effected in a punctual manner, i.e., by pressing, welding or similar, are required for joining the individual parts or making up the brassiere.

As a result of dispensing with seams produced by sewing which are in most cases inconvenient, affect the stretch behavior or might also be bulky, the novel brassiere also has improved wear properties. Because of its flat terminal edges and material transitions, the brassiere according to the invention is ideal for wearing under figure-hugging clothes, as it does not show through the clothes worn over it. Easy-care properties and simplified recycling possibilities result from the reduction in the number of different materials. Finally, the manufacturing method also permits improved reproduction of the required fit and a comparably favorable manufacturing cost structure.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIGS. 4 A/B are detailed views of the front central area of another embodiment of the brassiere with a butt weld; and FIGS. 5–7 are diagrammatic vertical sections of successive stations for producing a weld of this kind.

DESCRIPTION OF THE PREFERRED EMBODIMENTS

Figure 1:
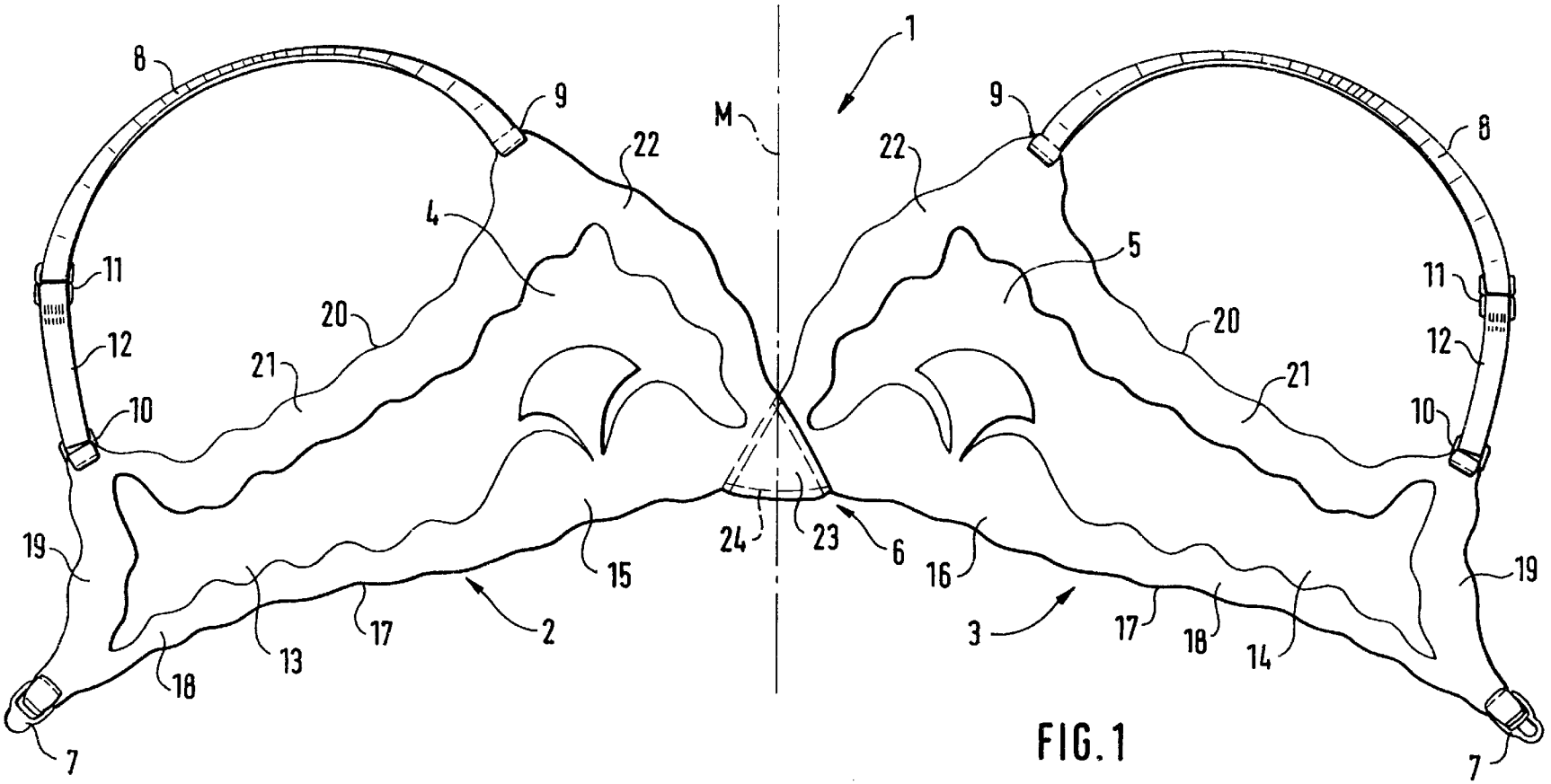
FIG. 1 is an internal view of a brassiere according to the invention.

The invention is represented in the drawings using the example of a brassiere as a ladies' undergarment. However, the invention may also be applied to other garments having a molded upper part such as, e.g., swimsuits or the like.

FIG. 1 shows a brassiere according to the invention from the inside. The brassiere 1 is composed of two side parts 2 and 3 which are formed and disposed in mirror-image fashion with respect to a front central axis M. The side parts 2 and 3 include a cup 4 and 5, respectively, shaped by molding. The side parts 2 and 3 are joined together in an area 6 around the front central axis M. The active and passive parts of a back fastener 7 are disposed at the back ends of the side parts 2 and 3. Shoulder straps 8 are attached in a fixed manner at 9 in the front top area of the side parts 2 and 3, above the cups 4 and 5, and in an adjustable manner at 10 in the back area in a loop 12 formed by an adjusting element 11.

Each side part 2 and 3 includes a layer 13 and 14, respectively, which covers their entire surface and is composed of a textile material which is to a certain extent stretchable and comprises at least in part thermoplastically fusible fibers. Reinforcement parts, which are designated as a whole by 15 and 16, respectively, are bonded to these base parts 13 and 14 from the inside. These reinforcement parts 15, 16 are also composed of a textile material, preferably a less stretchable material, which also comprises at least in part thermoplastically fusible fibers.

As shown in FIG. 1, the reinforcement parts 15, 16 include frame-like blanks extending approximately with a uniform width like a tape along the outer edges of the side parts 2 and 3 so as to reinforce and stabilize the edges. They include bottom parts 18, extending parallel to the bottom edge 17, parts 19 adjoining the parts 18 in the back area and extending to the shoulder straps 8, parts 21 extending along the top edges 20, and finally, parts 22 extending above the cups 4, 5. Starting from the bottom edge 17 of the brassiere 1, the parts 18 of the reinforcements 15, 16 extend into the area of the cups 4 and 5, so that they form reinforcements 23 to support the breasts or shape their contour.

Although the undergarment according to the invention is represented here using the example of a brassiere with a back fastener and shoulder straps, the invention is not restricted to this. The brassiere may have a front fastener instead of a back fastener as a so-called "step-in bra". It may equally be formed without shoulder straps, i.e., be strapless. Finally, the invention may also be applied to swimsuits, both one-piece swimsuits and bikinis.

In order to produce the brassiere according to the invention, the two side parts 2 and 3 are produced first and are then joined together in the front central area 6 and, finally, the shoulder straps 8 and the fastener parts 7 are attached.

In order to produce the side parts 2 and 3 of the brassiere 1, a coating is first applied to a base web or a rough blank of the textile material forming the reinforcements 15, 16 to enable this material to be joined to the base webs 13 and 14. This may be either a "hot melt" adhesive coating or a thin film which can be activated by applying heat. The inner contours of the reinforcement parts 15, 16 are then punched out of this rough blank and the remaining frame-like parts—still without an outer contour—are placed on the rough blank for the bank parts 13 and 14. The rough blanks comprising the reinforcement parts 15, 16 are joined to the rough blanks 13, 14 of the base web by applying heat and pressure. Only then are the cups 4 and 5 molded and the outer contour punched. In this respect it is appropriate to place two corresponding side parts 2 and 3 on top of one another so that they are congruent with on another.

The assembly stage commences after these preparatory measures. For this purpose, the parts 2 and 3, which have been punched and molded in a superimposed position, are opened out, overlapped in triangular fashion at 23 in the front central area 6 of the central axis M and are firmly joined together in this area by a weld 24. This may be effected by a single pressing and welding operation. This joint may also be made visually attractive by creating a motif, e.g., a "flower".

The parts of the back fastener 7 and the shoulder straps 8 are then attached. This is illustrated in FIGS. 2 and 3, which are both detail views on a larger scale.

Figure 2A:
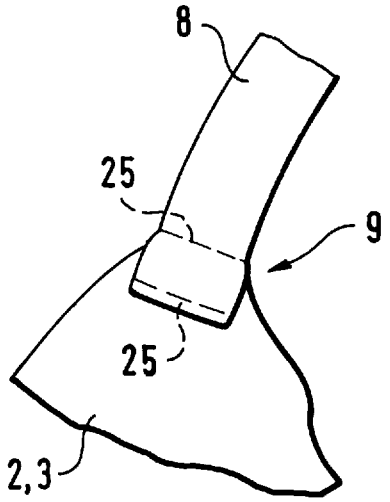
FIG. 2 A/B are detailed views of the shoulder strap attachment.
Figure 2B:
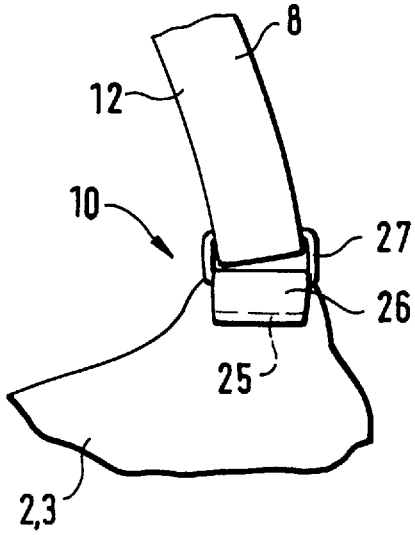

FIG. 2A shows how the shoulder straps 8 are joined to the front top areas of the brassiere 1 at 9 in a fixed manner.

The shoulder straps 8, which in most cases are composed of an elastic tape material, generally comprise thermoplastically fusible fibers, so that, when overlapped with the corresponding areas of the side parts 2 and 3, they can be joined together by welds 25. In order to attach the shoulder straps 8 in an adjustable manner at 10 in the back area (FIG. 2 B), a tongue 26 is formed from the material of the side parts 2 and 3 with bonded reinforcement, pulled through an eyelet 27 and then folded back. The tongue 26 is welded to the side parts 2 and 3 by a weld 25. The shoulder strap 8 is pulled, in a manner known per se, through the eyelet 27 and forms a loop 12.

Figure 3A:
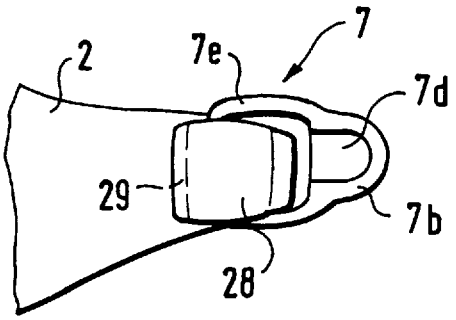
FIGS. 3A/B are detailed views of the attachment of the parts of a back fastener.
Figure 3B:
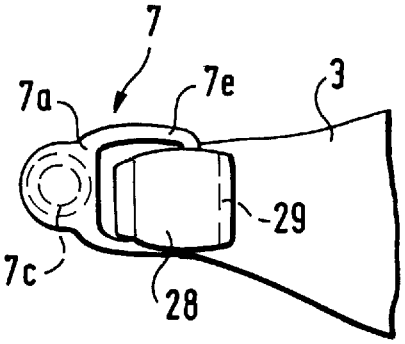

The procedure with respect to the parts of the back fastener 7 is similar (FIG. 3). The back fastener 7 is composed of an active fastener part 7*a* and a passive fastener part 7*b*. The active fastener part 7*a* has a fastener head 7*c*, the passive fastener part 7*b* a recess 7*d*. Both fastener parts 7*a* and 7*b* continue into an eyelet 7*e*. The ends of the side parts 2 and 3 also terminate in tongues 28, which are each pulled through the eyelets 7*e* and turned back, so as to then be welded to the material of the side parts 2 and 3 by welds 29.

There is consequently no need for any sewing operations extending over a distance and requiring a sewing medium in order to make up the brassiere according to the invention; instead, the manufacturing process is restricted to simple punching, pressing and welding operations and, therefore, to operations which can be simply carried out by automatic machines, to which they are adapted.

Whereas in the embodiment shown in FIG. 1 the side parts 2, 3 of the brassiere 1 according to the invention are brought into contact in the front central area 6 by an overlap 23 and joined by a weld 24 which corresponds to the triangular outline of the lap joint and is also triangular, the side parts 2, 3 may also be joined together edge-to-edge in a butt weld 30 in the front central area 6 between the cups 4, 5. This possibility is shown in detail in a front view in FIG. 4A and in a corresponding detailed view from the inside in FIG. 4B. FIGS. 5–7 are diagrammatic representations of several successive phases showing how a butt weld of this kind can be produced in a simple manner.

This simple joining possibility is due to the fact that according to the invention textile materials which are comprised at least in part of thermoplastically fusible fibers are used both for the rough blanks 13, 14 of the side parts and for the reinforcement parts 15, 16. Fibers of this kind may be welded by applying ultrasound or heat, possibly with the simultaneous application of pressure. Once the side parts 2, 3 consisting of the tough blanks 13, 14 and the reinforcement parts 15, 16 have been placed on top of one another so that they are congruent with one another, these can as a result be joined together in the area of the ends 32, 33, which subsequently form the front central area 6, by welding under the application of pressure and with complete severance such that, after parts 2, 3 have been opened out, the two ends 32, 33, which have been welded together one on top of the other, take up a flat position and are butt-welded edge-to-edge. It is thus possible to join the two front inner ends of the side parts 2, 3 in a practically invisible, or in any case non-bulky rectilinear fashion.

In order to safeguard this weld 30 and at the same time reinforce this front central area 6, which is highly stressed, of the brassiere 1, it is appropriate to bond a reinforcement part 31, preferebaly to the inside of the brassiere, in this area, wherein the reinforcement part appropriately is composed of the same material as the actual side parts 2, 3 and may be joined to these material layers in the same way as the different layers of the side parts 2, 3 are joined ( FIGS. 4A/B).

FIGS. 5–7 show how a butt weld 30 of this kind can be advantageously produced.

FIG. 5 shows in diagrammatic form how the two side parts 2, 3 composed of the base material 13, 14 and the reinforcement parts 15, 16 are placed one on top of the other such that the front inner ends 32, 33 thereof cover one another. The double-layer area is then brought into the range of action of an ultrasonic welding device 34, which is simply indicated by a sonotrode 34*a* and a bottom abutment 34*b*. The bottom abutment 34*b* has a triangular cross-section in its top part, which faces the material, so as to achieve not just welding, but also separation of material parts.

Energy is supplied to the material disposed between the sonotrode 34*a* and the abutment 34*b* by lowering the sonotrode 34*a* in the direction of the arrow 35. This results in heat being generated and the plastics filaments in the two material layers thus being welded. The weld 30 joining the two superimposed ends 32, 33 of the side parts 2, 3 is indicated in FIG. 6, which shows the situation following welding and separation.

The two front central edges 32, 33 of the side parts 2, 3 are thus joined together.

Once the two side parts 2 and 3 have been opened out, the ends 32, 33, which were previously still superimposed, take up a flat position (FIG. 7), in which the side parts 2, 3 are butt-jointed edge-to-edge at their ends 32, 33.

While specific embodiments of the invention have been shown and described in detail to illustrate the inventive principles, it will be understood that the invention may be embodied otherwise without departing from such principles.

I claim:

1. A ladies' undergarment, in particular a brassiere, comprising two side parts each including a cup, means for joining together the cups in a front central area, the side parts further having back ends and a back fastener connected to the back ends, further comprising shoulder straps connected to the side parts, each side part including a blank covering the entire surfaces of the side parts and being composed of a textile material comprising at least in part thermoplastically fusible fibers, reinforcement parts being bonded to the blanks at least along outer edges of the blanks, the reinforcement parts being composed of a textile material comprising at least in part thermoplastically fusible fibers, wherein the means for joining the cups in the front central area comprises a thermally produced weld, wherein the back fastener as well as the shoulder parts are joined to the side parts by thermally produced welds.

2. The ladies' undergarment according to claim 1, wherein the blanks of the side parts are of an elastic material.

3. The ladies' undergarment according to claim 1, wherein the reinforcement parts are of an elastic material.

4. The ladies' undergarment according to claim 1, wherein the reinforcement parts are comprised of a tape extending with a substantially uniform width along the edges of the side parts.

5. The ladies' undergarment according to claim 4, wherein, starting from a bottom edge of the undergarment, the reinforcement parts extend into the cups.

6. The ladies' undergarment according to claim 1, wherein the undergarment has an outer contour and the reinforcement parts are arranged so as to be adaptable to respective fit requirements.

7. The ladies' undergarment according to claim 4, wherein the reinforcement parts are comprised of an undulating tape.

8. The ladies' undergarment according to claim 1, wherein the side parts overlap in the front central area between the cups and are joined together in the overlapping area by a weld.

9. The ladies' undergarment according to claim 1, wherein the side parts have facing ends, the facing ends being butt-welded together in the front central area between the cups.

10. The ladies' undergarment according to claim 9, further comprising a bonded reinforcement part attached on the inside of the undergarment to the weld.

11. The ladies' undergarment according to claim 1, wherein the side parts comprise at back ends thereof narrow tongues, the back fastener comprising eyelets, wherein the tongues are passed through the eyelets and are closed by forming a loop.

12. The ladies' undergarment according to claim 1, wherein the side parts comprise front and back shoulder strap fixtures, wherein the shoulder straps are joined directly to the side parts at the shoulder strap fixtures.

13. The ladies' undergarment according to claim 12, wherein the shoulder straps are attached to the back shoulder strap fixtures so as to be adjustable by means of a loop formed at an eyelet, wherein each eyelet is in turn joined to the side parts by means of a tongue, wherein the tongue is pulled through the eyelet and is formed into a loop.

* * * * *